United States Patent [19]

Pries

[11] 4,194,951

[45] Mar. 25, 1980

[54] COKE OVEN QUENCHING CAR

[75] Inventor: Erich Pries, Bochum, Fed. Rep. of Germany

[73] Assignee: Dr. C. Otto & Comp. G.m.b.H., Bochum, Fed. Rep. of Germany

[21] Appl. No.: 886,492

[22] Filed: Mar. 14, 1978

[30] Foreign Application Priority Data

Mar. 19, 1977 [DE] Fed. Rep. of Germany ..... 2712111

[51] Int. Cl.[2] ..... C10B 39/10; C10B 39/14

[52] U.S. Cl. ..... 202/227; 202/263

[58] Field of Search ..... 202/227, 228, 262, 263

[56] References Cited

U.S. PATENT DOCUMENTS

| | | | |
|---|---|---|---|
| 1,424,777 | 8/1922 | Schondeling | 202/227 X |
| 3,367,844 | 2/1968 | Cremer | 202/227 |
| 3,748,235 | 7/1973 | Pries | 202/263 X |
| 3,766,018 | 10/1973 | Riechert | 202/263 X |
| 3,869,352 | 3/1975 | Allen et al. | 202/227 |

FOREIGN PATENT DOCUMENTS

| | | | |
|---|---|---|---|
| 903714 | 8/1962 | United Kingdom | 202/227 |

*Primary Examiner*—Arnold Turk

*Attorney, Agent, or Firm*—Thomas H. Murray; Clifford A. Poff

[57] ABSTRACT

An enclosed quenching car movable along a battery of coke ovens and adapted to receive coke from each oven in succession and quench it without polluting the atmosphere. The car includes an enclosure containing a pivotal quenching tank with interior dimensions substantially corresponding to the dimensions of the carbonized coke cake to be accommodated therein. One side of the pivotal tank is formed from a water-permeable grid such that the coke cake within the tank can be rotated into a horizontal plane and the coke completely immersed in water passing through the permeable grid; while dust and gases are extracted without polluting the atmosphere. In this manner, the coke is quenched in such a way that it is yielded in large pieces with a defined uniform water content in the coarse and fine coke.

8 Claims, 3 Drawing Figures

COKE OVEN QUENCHING CAR

BACKGROUND OF THE INVENTION

As is known, numerous proposals have been made to prevent pollution of the atmosphere during pushing and quenching of carbonized coke. One such proposal, for example, utilizes a receiving car which can traverse in front of a coke oven battery and which carries a metal mesh or metal grid for receiving the carbonized coke charge. The grid has a height, width and length substantially corresponding to the dimensions of the coke cake to be accommodated therein and is positioned within an enclosure on the receiving car which can be connected in smoke-tight manner to the coke oven which is to be pushed.

A receiving car of this type serves to transport the coke cake to a quenching device which can comprise a quenching tower in which the metal mesh casing containing the carbonized coke charge is positioned and pivoted through 90° so that one longitudinal side wall of the coke cake is positioned beneath the spray heads of the quenching tower. After the coke is quenched by the water sprays, which pass through the walls of the metal mesh casing, the casing is pivoted back into a substantially vertical position and the quenched coke is transported by the receiving car to a discharge point. This system, of course, requires a separate quenching tower and necessitates a two-step process, the coke being initially transported to the quenching tower and thereafter transported therefrom.

SUMMARY OF THE INVENTION

In accordance with the present invention, coke-quenching apparatus is provided wherein the necessity for a separate quenching tower is eliminated, the coke being quenched within an enclosure carried on a receiving car containing coke-quenching apparatus. The coke-quenching apparatus comprises a pivotal quenching tank having interior dimensions corresponding to those of the coke cake to be quenched. At least one, and preferably both, ends of the quenching tank are provided with door means to permit a coke cake to be received therein and discharged therefrom. Only one side of the tank is formed from a water-permeable grid such that when the tank is rotated from a position where the coke cake extends in a vertical direction to a substantially horizontal position, water can be sprayed through the grid to completely immerse the coke cake within the tank. The water is allowed to remain in the tank until the temperature of the coke has dropped sufficiently and temperature compensation has taken place between coarse and fine pieces of coke. As a result, very uniform cooling of all parts of the coke cake can take place, meaning that no pieces of coke remain which are excessively or insufficiently quenched. Furthermore, any small coke particles detached on quenching are collected within the cracks of the coke and are prevented from escaping with the water vapor which develops during quenching.

After an adequate time of immersion, the tank is again pivoted into a vertical position to drain water from the coke cake; and the door means on the tank opposite the coke oven is opened to permit coke to be discharged from the tank and through a closable bottom opening in the enclosure on the quenching car and into a suitable receptacle. Gases, vapors and dust particles are extracted from the enclosure during the quenching process and conveyed to suitable gas and dust-collecting apparatus without permitting them to escape to the atmosphere.

Two advantages result from the fact that the coke does not disintegrate in the hot, glowing state but only in the cold state. First, disintegration in the cold state develops less dust. Secondly, since the mechanical strength of coke in the cold state is greater than when it is hot, it means that the coke is yielded in larger pieces.

The above and other objects and features of the invention will become apparent from the following detailed description taken in connection with the accompanying drawings which form a part of this specification, and in which.

Figure 1:
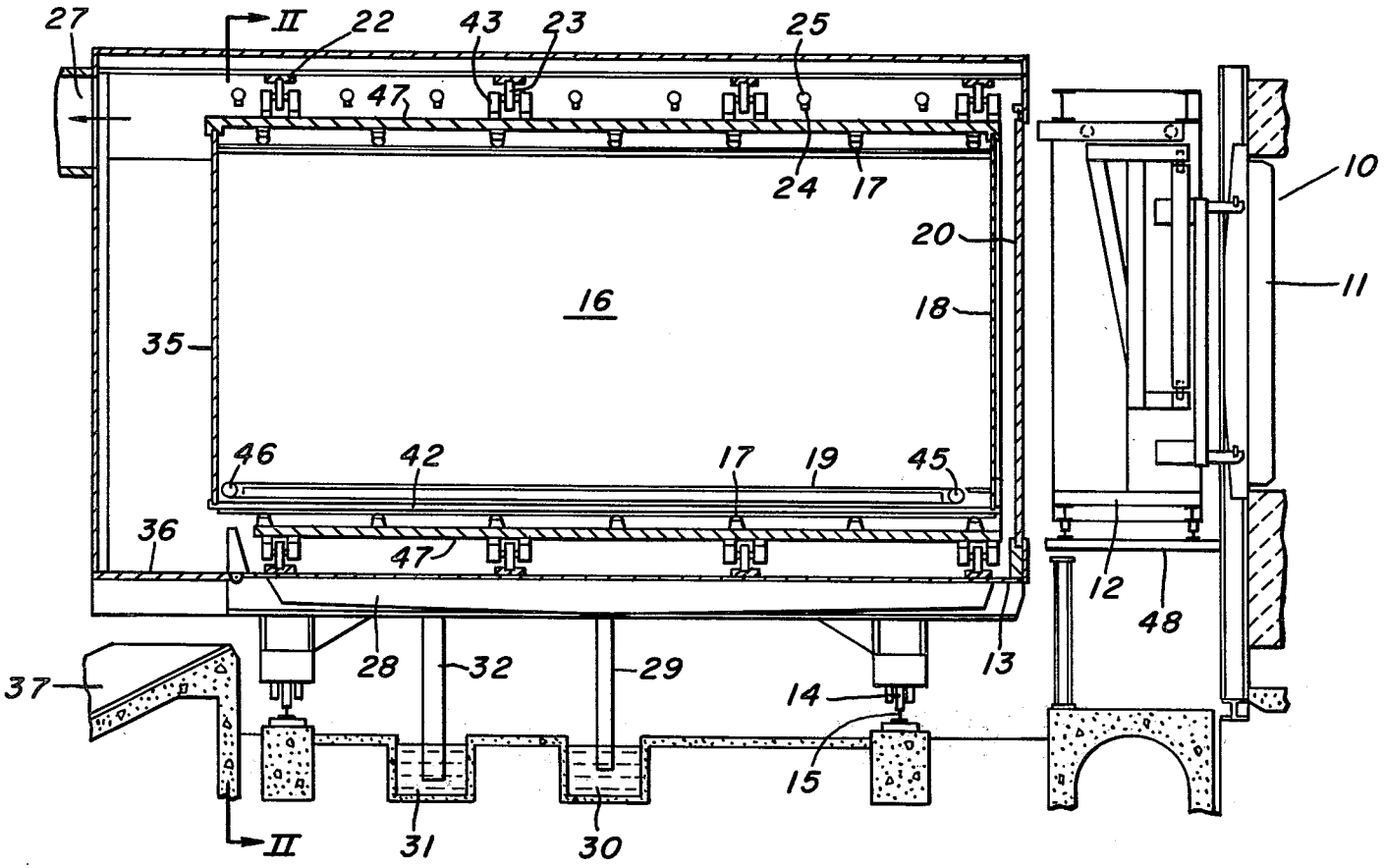
FIG. 1 is a vertical longitudinal section through the quenching car of the invention situated in front of a coke oven.

With reference now to the drawings, and particularly to FIG. 1, a coke oven is indicated generally by the reference numeral 10 and is provided with a door 11 at its coke or discharge end. Movable along the coke side of the battery of coke ovens, on tracks mounted on an oven platform 48, is a door-extracting machine 12 which carries a coke guide which can be telescopically extended so as to be attached in smoke-tight manner to the oven opening as well as to a coke quenching tank 16, about to be described.

The quenching car of the invention is provided with sets of wheels 14 mounted on tracks 15 extending along the coke side of the coke oven battery such that the quenching car can move from one coke oven chamber to the next. The wheels 14 depend downwardly from an underframe which carries an air-tight enclosure 13 provided with an entrance door 20 at its forward end and a discharge door 36 at its trailing end through which coke can be discharged onto a coke chute 37.

Figure 3:
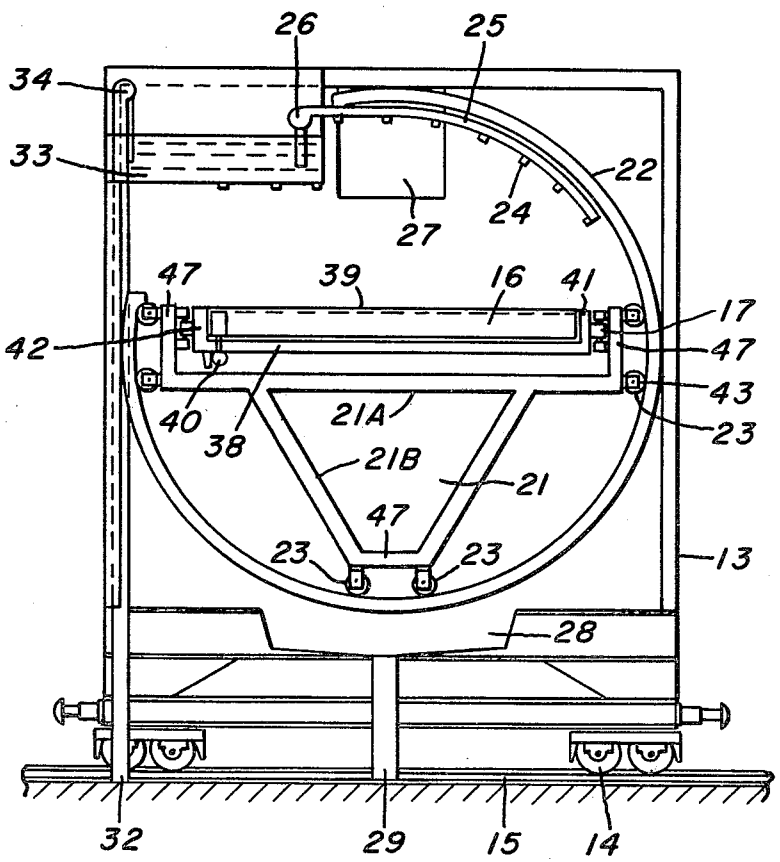
FIG. 3 is a vertical section similar to that of FIG. 2 but wherein the quenching tank is in a horizontal position during a quenching operation.
Figure 2:
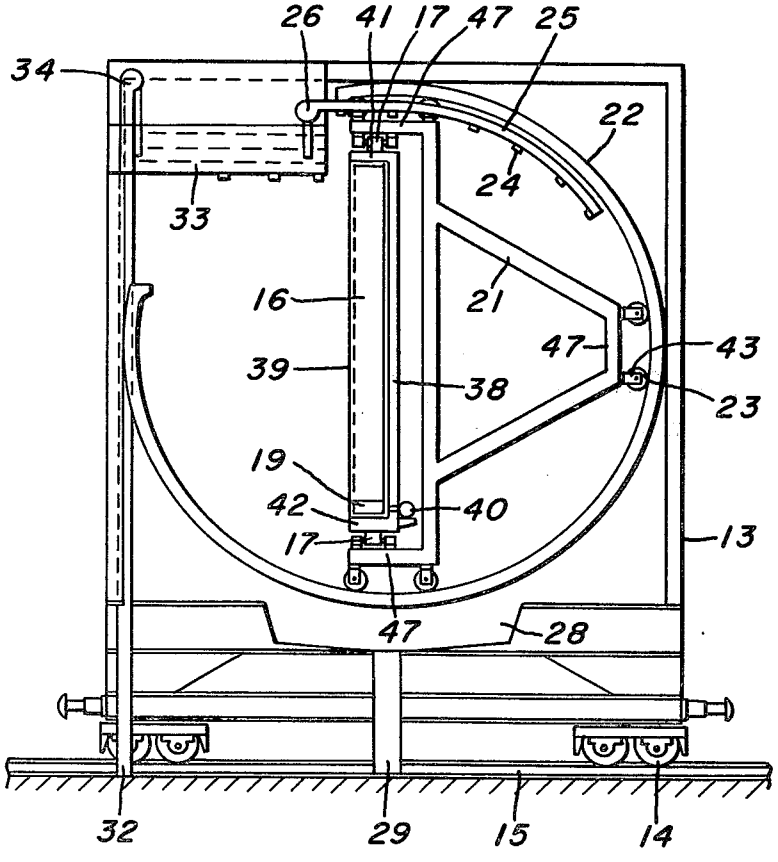
FIG. 2 is a vertical section taken substantially along line II—II of FIG. 1 with the quenching tank situated within an enclosure being in a vertical position for receiving a coke cake from a coke oven.

As is best shown in FIGS. 2 and 3, within the enclosure 13 are circular tracks 22 which receive wheels 23 mounted in bearings 43. The bearings 43 are carried on the outsides of longitudinally-extending members 47 of a rotatable frame 21 which, as shown in FIGS. 2 and 3, has a generally rectangular portion 21A extending diametrically across the tracks 22 and radially-outwardly extending struts 21B which connect the rectangular portion 21A to a longitudinal member 47 carrying wheels 23.

The rectangular portion 21A supports the quenching tank 16 which comprises an imperforate longitudinal wall 38 and an oppositely-disposed grid 39 constructed of individual grids or plates which retain the coke cake but permit water to pass therethrough. The ends of the wall 38 and grid 39 are interconnected by means of longitudinal transversely-extending walls 41 and 42 which, like the wall 38, are imperforate. At the front of the quenching tank 16, as best shown in FIG. 1, is a water-tight door 18 which can be pivotal or slideable to permit entry of a coke cake into the quenching tank during pushing of the coke oven 10. A rear transverse wall 35 is also constructed as a door. That is, the wall 35, which is water-tight, is pivotal or slideable to permit discharge of a coke cake from the quenching tank in a manner hereinafter described. The quenching tank 16 can move longitudinally within the frame 21 by means of rollers 17 mounted on the cross members at the top and bottom of the frame 21 as viewed in FIG. 2. A steel conveyor belt 19, which passes around rolls 45 and 46 at opposite ends of the quenching tank 16, is disposed above the bottom longitudinal wall 42 as viewed in FIG. 1. The roll 46, situated at the trailing end of the quenching tank 16, can be driven by means of motor 40 shown in FIGS. 2 and 3.

Also disposed within the enclosure is a quenching tank 33 supplied with quenching water by pump 34 which pumps the water through a pipe 32 immersed in a trough 31 (FIG. 1) positioned beneath the tracks 15 on which the quenching car of the invention rides. Water from the tank 33 is pumped by means of pumps 26 through arcuate quenching water pipes 25 and thence through nozzles 24 which spray water over the entire surface of the grid 39 when the tank 16 is in the horizontal position shown in FIG. 3. Vapors and dust produced during the quenching operation are extracted by an extraction duct 27 (FIG. 1) and directed into a collecting pipe, not shown, which communicates with a cleaning device from which the gases and vapors are discharged into the atmosphere after they have been sufficiently freed of toxic constituents.

A bottom basin 28 is carried within the enclosure 13 to collect water from the quenching tank 16 as it is rotated from the horizontal position of FIG. 3 to the vertical position of FIG. 2 following a quenching operation. Basin 28, in turn, is connected through a downcomer 29 (FIG. 1) to a waste-water trough 30 also disposed beneath the tracks 15.

In the operation of the invention, both the forward door 20 of the enclosure 13 and the forward door 18 of the quenching tank 16 are initially opened. If a telescopically extensible coke guide is carried on the door-extraction machine 12, the coke guide can be abutted in smoke-tight manner to the oven opening as well as the forward end of the quenching tank 16 when the forward door 18 is retracted. In this manner, the coke cake can be transferred to the quenching tank 16 without any substantial emission of pollutants. Upon completion of the transfer of the coke cake into the tank 16, the coke guide will be retracted and the doors 18 and 20 essentially simultaneously closed. It is, however, possible to dispense with a telescopic coke guide, in which case the doors 18 and 20 are opened and the tank 16 caused to traverse forwardly on the rollers 17 until it is in abutment with the opening of the oven 10; whereupon the coke cake is pushed into the tank 16. Upon completion of the pushing operation, door 18 is closed; the tank 16 containing the coke cake is retracted back into the enclosure 13 on the rollers 17; and door 20 of the enclosure 13 is closed. If this latter procedure is employed, it is desirable to provide a smoke-collecting hood or shield for gathering any smoke and dust which emanates from that portion of the grid projecting beyond the enclosure 13 during a pushing operation. The hood, for example, can be hinged to the enclosure 13 and pivoted into a smoke-collecting position during a pushing operation.

During the quenching operation, sufficient water is supplied through the nozzles 24 until the tank 16 is filled while in the horizontal position shown in FIG. 3. The water is then allowed to remain in the tank until the coke is sufficiently impregnated. Thereafter, the tank 16 is rotated back into the position shown in FIG. 2, whereupon water within the tank 16 flows into basin 28 and thence into the discharge trough 30. The rear door 35 of the tank 16 is then opened as well as the discharge door 36. The motor 40 is then energized to cause the steel conveyor belt 19 to pass around rolls 45 and 46, in which process the coke cake is discharged through the rear door 34 and falls down onto the ramp 37.

It will be appreciated that the quenching apparatus of the invention can be utilized in combination with the door-extracting and cleaning machine for coke ovens described in U.S. Pat. No. 4,026,768, assigned to the Assignee of the present application. By reference to that patent, it will be seen that it discloses a car which can traverse the coke side of an oven battery and on which a coke guide, a door cleaner and a door frame cleaner are carried. The quenching chamber of the invention can be carried on the car of the door-extracting and cleaning machine of U.S. Pat. No. 4,026,768 and a separate door-extracting machine, such as machine 12 of FIG. 1, can be eliminated. Furthermore, and assuming that the door-extracting apparatus incorporates cleaning means for the door and the door frame, the cleaning operation can be carried on while quenching is accomplished within the enclosure 13.

Although the invention has been shown in connection with a certain specific embodiment, it will be readily apparent to those skilled in the art that various changes in form and arrangement of parts may be made to suit requirements without departing from the spirit and scope of the invention.

I claim as my invention:

1. A coke quenching apparatus including the combination of a quenching car movable along a battery of coke ovens and adapted to receive and quench a carbonized coke cake from said ovens, said car carrying a substantially gas-tight enclosure having door means at opposite ends thereof, a quenching tank disposed within said enclosure, said quenching tank being generally rectangular and having interior dimensions corresponding substantially to those of a coke cake to be quenched, one side of the tank being solid and one side being formed from a water-permeable grid, at least one end of the tank comprising door means to permit passage of a coke cake therethrough, water spray means in the enclosure adapted to spray water uniformly over the tank, and means for rotatably mounting the tank in the enclosure for movement between a vertical position wherein the sides of the tank are vertically disposed for receiving or discharging coke and a horizontal position for quenching the coke in which said solid side is below said water-permeable grid, whereby said water passes into the tank through said grid and is retained in the tank to completely immerse the coke cake.

2. The quenching apparatus of claim 1 including door means at opposite ends of said quenching tank, the forward door means being opened as a coke cake is pushed into the quenching tank and the rearward door means being opened as the coke cake is discharged from the quenching tank.

3. The quenching apparatus of claim 1 including gas-collecting means connected to said enclosure for conveying gases and dust produced during quenching to collecting means.

4. The quenching apparatus of claim 1 including a collecting basin at the bottom of said enclosure for collecting quenching water which spills from said quenching tank as it is rotated from said substantially horizontal position back to a position where the coke cake extends in a vertical direction.

5. The quenching apparatus of claim 1 including means carried within said quenching tank for discharging quenched coke therefrom at the completion of a quenching operation.

6. The quenching apparatus of claim 5 wherein said means for discharging comprises conveyor belt means disposed at the bottom of said quenching tank when said coke cake extends in a vertical direction.

7. The quenching apparatus of claim 1 including a quenching water tank carried within said enclosure, and nozzles connected to said tank for spraying water from the tank uniformly over said water-permeable grid when the quenching tank is in a substantially horizontal position.

8. The quenching apparatus of claim 7 including a water trough extending along said battery of coke ovens, pipe means carried on said quenching car and having a lower end immersed in said trough, and pump means for pumping water from said trough into said quenching water tank.

* * * * *